US005950470A

United States Patent [19]

Prewo et al.

[11] Patent Number: 5,950,470

[45] Date of Patent: Sep. 14, 1999

[54] METHOD AND APPARATUS FOR PEENING THE INTERNAL SURFACE OF A NON-FERROMAGNETIC HOLLOW PART

[75] Inventors: Karl M. Prewo, Vernon; Pedro Sainz de Baranda, Farmington; Vincent C. Nardone, South Windsor, all of Conn.

[73] Assignee: United Technologies Corporation, Hartford, Conn.

[21] Appl. No.: 09/149,972

[22] Filed: Sep. 9, 1998

[51] Int. Cl.[6] ..... B21D 26/14; B24C 1/00

[52] U.S. Cl. ..... 72/53; 72/430; 72/707

[58] Field of Search ..... 72/53, 707, 430, 72/54; 29/90.7; 451/38

[56] References Cited

U.S. PATENT DOCUMENTS

| | | | |
|---|---|---|---|
| 4,039,794 | 8/1977 | Kasper | 219/10.49 |
| 4,080,760 | 3/1978 | Leliert . | |
| 5,509,286 | 4/1996 | Coulon | 72/53 |
| 5,813,265 | 9/1998 | Shaw et al. | 72/53 |
| 5,829,116 | 11/1998 | Vilon | 72/53 |

FOREIGN PATENT DOCUMENTS

| | | | |
|---|---|---|---|
| 456704 | 1/1975 | U.S.S.R. | 72/53 |
| 1435627 | 11/1988 | U.S.S.R. | 72/53 |

*Primary Examiner*—David Jones
*Attorney, Agent, or Firm*—Brian D. Lefort

[57] ABSTRACT

The present invention is a method and apparatus for peening the internal surface of non-ferromagnetic hollow parts. Ferromagnetic peening elements are inserted into the non-ferromagnetic hollow part, and a magnetic dipole creates a magnetic field through the non-ferromagnetic hollow part attracting the peening elements which contact a portion of the internal surface of the non-ferromagnetic hollow part. The magnetic field is disengaged and a second magnetic dipole creates a second magnetic field, thereby causing the peening elements to contact a second portion of the internal surface. The magnetic dipoles are repeatedly turned on and off, thereby causing repeated impact within the interior of the hollow part until the internal surface attains a predetermined stress level.

14 Claims, 1 Drawing Sheet

METHOD AND APPARATUS FOR PEENING THE INTERNAL SURFACE OF A NON-FERROMAGNETIC HOLLOW PART

TECHNICAL FIELD

This invention relates to a method and apparatus for peening and more particularly to a method and apparatus for peening the internal surface of a non-ferromagnetic hollow part.

BACKGROUND ART

Most metal parts operate in an environment which eventually leads to corrosion or the creation of stress induced cracks, thereby reducing the useful life of such parts. It is known that peening the surface of metal parts can induce compressive residual surface stresses, thereby increasing the resistance of the part to fatigue, cracking and corrosion. Numerous methods exist which relate to peening the exterior surface of metal parts. However, these methods are not applicable to peening the internal surface of hollow parts because such methods fail to take into account the peculiar difficulties associated with peening the internal surface.

U.S. Pat. No. 2,460,657 addressed some of the distinctive characteristics associated with peening the internal surface of a hollow part. Specifically, that patent taught that vibrating the part produced repeated impact between the peening elements and the internal surface of the hollow part. Vibrating the part, however, may be impractical in many instances due to the size and shape of the part. Vibrating the entire part also limits the ability to control or vary the peening intensity at different points along the internal surface. Furthermore, vibrating the part may itself increase the stress within the part, thereby initiating the formation of cracks and negating the benefit attained from peening.

DISCLOSURE OF INVENTION

It is an object of the present invention to provide a method and apparatus for peening the internal surface of a hollow part by inciting contact between the peening elements and the internal surface without vibrating the hollow part.

It is a further object of the present invention to provide a method for peening the internal surface of the hollow part until a portion of the surface attains a predetermined stress level.

It is a further object of the present invention to provide a method and apparatus to tailor the intensity of the peening at different locations of the internal surface.

According to the present invention, there is provided a method and apparatus for peening an internal surface of a non-ferromagnetic hollow part by repeatedly creating a magnetic field which passes through the hollow part and causes the ferromagnetic peening elements, inserted therein, to repeatedly impact a portion of the internal surface.

An alternate method of the present invention includes creating a second magnetic field, which attracts the ferromagnetic peening elements toward a second portion of the internal surface. The original and second magnetic fields repeatedly alternate until the internal surface attains a predetermined stress level.

The foregoing objects, features and advantages of the present invention will become more apparent in light of the following detailed description of exemplary embodiments thereof as illustrated in the accompanying drawings.

BEST MODE FOR CARRYING OUT THE INVENTION

Figure 1:
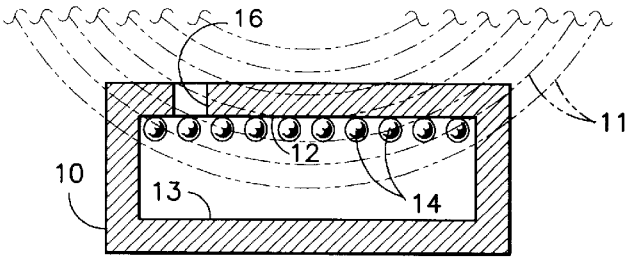
FIG. 1 is a partial sectional view of a magnetic field passing through a hollow part containing peening elements.

Referring to FIG. 1, a magnetic field, depicted by lines 11, passes through a non-ferromagnetic hollow part (hereinafter referred to as hollow part) 10. Ferromagnetism is a property, exhibited by certain metals, alloys, and compounds of the transition (iron group) rare-earth and actinide elements, in which the internal magnetic moments spontaneously organize in a common direction. Ferromagnetic material includes certain forms of iron (e.g., steel), cobalt and nickel, which display a high degree of ferromagnetism. Non-ferromagnetic materials are materials such as titanium, aluminum, magnesium, ceramics, and polymers, which do not display the property of ferromagnetism. There are also weakly ferromagnetic materials including certain cobalt alloys, nickel alloys and austentic stainless steels which display a lesser degree of ferromagnetism than ferromagnetic materials. For the purpose of this disclosure, non-ferromagnetic materials include weakly ferromagnetic materials. Ferromagnetic peening elements (hereinafter referred to as peening elements) 14, such as steel spherical balls, are inserted into the interior of the hollow part 10 through an opening 16 and rest upon the bottom internal surface 13. Peening elements other than those constructed of steel and in the shape of balls may also be used. An obstruction plugs the opening 16 and the peening elements 14 become completely encapsulated within the interior of the hollow part 10.

A method for peening the internal surface(s) of the hollow part 10 comprises creating a magnetic field which passes through the hollow part 10, thereby attracting the peening elements 14 and causing them to contact the top internal surface 12. Upon or after impact, the magnetic field is eliminated, thereby allowing gravity and the elastic reaction between the peening elements 14 and top internal surface 12 to drive the peening elements toward the bottom internal surface 13. Upon or after the peening elements 14 impact the bottom internal surface 13, the magnetic field is recreated, thereby causing the peening elements 14 to contact the top internal surface 12 again. The process of recreating and eliminating the magnetic field is repeated until the top and/or bottom internal surfaces 12, 13 attain a predetermined stress level.

Figure 2:
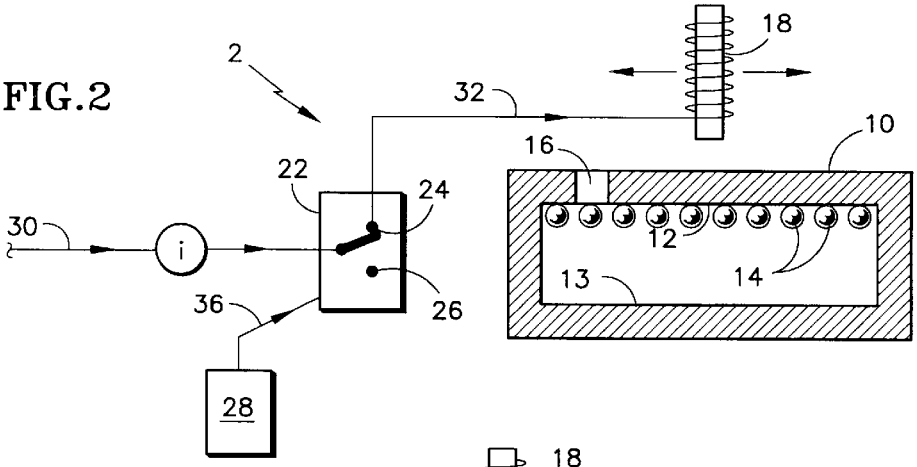
FIG. 2 is a schematic of a peening apparatus made in accordance with the present invention depicting a hollow part, peening elements, an electromagnet and a switch.

An apparatus 2 for peening the internal surface of a hollow part 10 is illustrated in FIG. 2 and comprises ferromagnetic peening elements 14, an electromagnet 18, and a switch 22. The switch 22 has a first position 24 and a second position 26. When the switch 22 is in the first position 24, direct current, as depicted by the symbol "i", travels along line 32 to the electromagnet 18, which creates a magnetic field. The magnetic field is substantially transparent to the hollow part but attracts the peening elements 14, thereby causing them to move toward the electromagnet 18 and the top internal surface 12. The field strength is sufficient that the peening elements 14 move toward and contact (i.e., impact) the top internal surface 12 at a predetermined velocity.

Upon or after the peening elements 14 impact the top internal surface 12, the position of the switch 22 is changed to the second position 26. When the switch 22 is in the second position 26, power fails to travel to the electromagnet 18, thereby eliminating the magnetic field. Gravity and the impact reaction between the peening elements 14 and the top internal surface 12 causes the peening elements 14 to move toward and impact the bottom internal surface 13. Upon or after the peening elements 14 impact the bottom internal surface 13, the position of the switch 22 is changed back to the first position 24, thereby recreating the magnetic field, which again attracts the peening elements 14 toward the top internal surface 12. This cycle is repeated until the recurring impact between the peening elements 14 and the top internal surface 12 and/or the bottom internal surface 13 induces a compressive residual stress in the top internal surface 12 and/or the bottom internal surface 13 having a predetermined stress level.

A means of alternating the switch 22 between the first and second position 24, 26 comprises a control 28, which produces a control signal. The control signal travels along line 36 to the switch 22 and causes the switch 22 to alternate between the first and second position 24, 26 at a desired rate.

It may also be preferable to move the hollow part 10 or the electromagnet 18 in relation to one another, thereby allowing the magnetic field created by the electromagnet 18 to attract the peening elements 14 across the entire internal top surfaces 12. Moving the hollow port 10 and/or the electromagnet 18 will allow a portion of the material surface to be peened until such portion attains a specific desired stress level which may or may not be different from the predetermined stress level.

Figure 3:
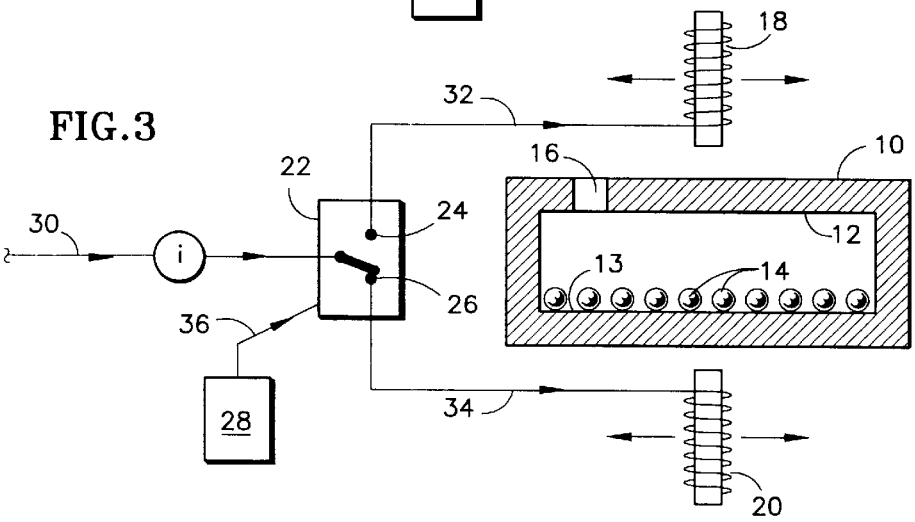
FIG. 3 is a schematic of a peening apparatus as similarly depicted in FIG. 2, but further including a second electromagnet.

An alternate embodiment of the present invention includes creating a second magnetic field, which attracts the peening elements 14 toward the bottom internal surface 13. A means for creating a second magnetic field, as illustrated in FIG. 3, comprises a second electromagnet 20. Upon alternating the positions 24, 26 of the switch 22, reversing magnetic fields pass through the hollow part 10, which is disposed between the electromagnet 18 and second electromagnet 20. Specifically, when the switch 22 is in the second position 26, power fails to travel to the first electromagnet 18, thereby eliminating the original magnetic field. However, the power travels along line 32 to the second magnetic dipole 20 creating a second magnetic field attracting the peening elements 14. Upon or after the peening elements 14 impact the bottom internal surface 13, the position of the switch 22 is changed back to the first position 24, thereby eliminating the second magnetic field and recreating the original magnetic field. This cycle is repeated until the repeated impact between the peening elements 14 and the top internal surface 12 and/or the bottom internal surface 13 induces a compressive residual stress in the top internal surface 12 and/or the bottom internal surface 13 having a predetermined stress level.

Figure 4:
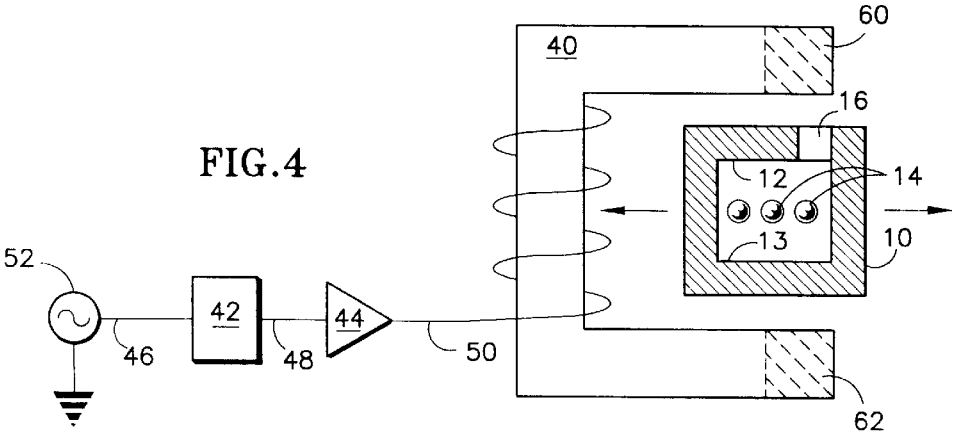
FIG. 4 is a schematic of an alternate embodiment of the present invention depicting a hollow part disposed between the two poles of an electromagnet receiving alternating current.

Referring to FIG. 4, an alternate embodiment of the present invention includes an electromagnet 40 having a first pole 60 and a second pole 62. A hollow part 10, disposed between the first pole 60 and a second pole 62, contains peening elements 14 disposed therein. A power source 52 provides alternating current (AC) to the electromagnet 40, along line 50. The AC current causes the magnetic field created between the first and second poles 60, 62 to alternate directions, thereby causing the peening elements 14 to alternately contact the top and bottom internal surfaces 12, 13 of the hollow part 10. It is preferable to match the frequency of the current supplied to the electromagnet 40 with the rate at which the peening elements 14 alternately contact the top and bottom internal surfaces 12, 13. One means for controlling the frequency of the alternating current comprises a wave generator 42, which receives the alternating current from the power source 52 along line 46 and alters the frequency of the alternating current supplied along line 48. The wave generator 42 adjusts the frequency of the AC current to a frequency approximately equal to the frequency at which the peening elements 14 alternately contact the top and bottom internal surfaces 12, 13. It is also preferable to include an amplifier 44 between the wave generator 42 and the electromagnet 40, thereby allowing the wave generator 42 to operate at lower power levels.

The present invention represents a substantial improvement over the prior art because the present invention is capable of peening the internal surface of a hollow part without vibrating the hollow part, thereby increasing the type of parts capable of being peened. The present invention also allows peening of the internal surfaces of complex geometrically shaped parts. Furthermore, the present invention may also be used to tailor the compressive residual stress in stress critical areas, thereby prolonging the useful life of the part.

Although the invention has been described and illustrated with respect to the exemplary embodiments thereof, it should be understood by those skilled in the art that the foregoing and various other changes, omissions and additions may be made without departing from the spirit and scope of the invention.

What is claimed is:

1. A method for peening an internal surface of a non-ferromagnetic hollow part, comprising the steps of:

(a) inserting a plurality of ferromagnetic peening elements into the non-ferromagnetic hollow part;

(b) creating a magnetic field through the non-ferromagnetic hollow part, thereby causing said ferromagnetic peening elements to impact a portion of the internal surface of the non-ferromagnetic hollow part;

(c) eliminating said magnetic field and allowing said peening elements to impact a second portion of the internal surface; and (d) repeating steps (b) and (c).

2. The method of claim 1 wherein steps (b) and (c) are repeated until said portion of the internal surface attains a predetermined stress level.

3. The method of claim 2 further comprising the step of moving said magnetic field relative to the non-ferromagnetic hollow part.

4. The method of claim 2 further comprising the step of moving the non-ferromagnetic hollow part relative to said magnetic field.

5. A method for peening an internal surface of a non-ferromagnetic hollow part, comprising the steps of:

(a) inserting a plurality of ferromagnetic peening elements into the non-ferromagnetic hollow part;

(b) creating a first magnetic field through the non-ferromagnetic hollow part, thereby causing said ferromagnetic peening elements to contact a first portion of the internal surface of the non-ferromagnetic hollow part;

(c) eliminating said first magnetic field;

(d) creating a second magnetic field through the non-ferromagnetic hollow part, thereby causing said ferromagnetic peening elements to contact a second portion of the internal surface of the non-ferromagnetic hollow part;

(e) eliminating said second magnetic field; and (f) repeating steps (b) through (e).

6. The method of claim 5 wherein steps (b) through (e) are repeated until said first portion and/or said second portion of the internal surface attain(s) a predetermined stress level.

7. The method of claim 5 further comprising the step of moving said magnetic field relative to the non-ferromagnetic hollow part.

8. The method of claim 5 further comprising the step of moving the non-ferromagnetic hollow part relative to said magnetic field.

9. An apparatus for peening a non-ferromagnetic hollow part having an exterior and interior, the exterior and interior both having a top and a bottom surface, comprising:

(a) ferromagnetic peening elements disposed within the interior of said non-ferromagnetic hollow part;

(b) an electromagnet disposed adjacent to the top exterior surface of the non-ferromagnetic hollow part; and (c) a switch having a first position and a second position, wherein said electromagnet creates a magnetic field causing said peening elements to impact the top interior surface of the non-ferromagnetic hollow part when said switch is in said first position and wherein the magnetic field is eliminated when said switch is in said second position.

10. The apparatus of claim 9 further comprising a second electromagnet disposed adjacent to the bottom exterior surface of the non-ferromagnetic hollow part and wherein said second electromagnet creates a second magnetic field causing said peening elements to impact the bottom interior surface of the non-ferromagnetic hollow part when said switch is in said second position and wherein said second magnetic field is eliminated when said switch is in said first position.

11. The peening apparatus of claim 9 or claim 10 further comprising a controller which delivers a control signal to said switch.

12. An apparatus for peening a non-ferromagnetic hollow part having an exterior and interior, the exterior and interior both having a top and a bottom surface, comprising:

(a) an electromagnet having a first pole and a second pole, the non-ferromagnetic hollow part disposed between said first and second poles, each pole having a different polarity and creating a magnetic field through the non-ferromagnetic hollow part, said magnetic field having a direction;

(b) ferromagnetic peening elements disposed within said interior of said hollow part; and (c) means for alternating the direction of the magnetic field, thereby causing said peening elements to alternately impact the top and bottom interior surfaces of the hollow part.

13. The apparatus of claim 12 wherein said means for alternating comprises a wave generator which supplies alternating current to said electromagnet.

14. The peening apparatus according to claim 13 further comprising an amplifier.

* * * * *